United States Patent [19]

Armbruster

[11] 4,424,006

[45] Jan. 3, 1984

[54] COMBINED POWER DEVICE, LIGHT AND FAN

[76] Inventor: Joseph M. Armbruster, 2700 N.E. 47th St., Lighthouse Point, Fla. 33064

[21] Appl. No.: 214,867

[22] Filed: Dec. 9, 1980

[51] Int. Cl.[3] ..... F04B 21/00

[52] U.S. Cl. ..... 417/234; 417/313; 417/411

[58] Field of Search ..... 417/411, 234, 313, 423

[56] References Cited

U.S. PATENT DOCUMENTS

| | | | |
|---|---|---|---|
| 2,065,270 | 12/1936 | DeMisa | 417/423 R |
| 2,133,188 | 10/1938 | Conforti | 417/313 |
| 2,582,572 | 1/1952 | Tulk | 416/5 |
| 3,916,870 | 11/1975 | Beavers | 126/116 R |

*Primary Examiner*—Richard E. Gluck
*Assistant Examiner*—Peter M. Cuomo
*Attorney, Agent, or Firm*—Harvey B. Jacobson

[57] ABSTRACT

A portable handyman's device containing a combination of independently operated electrical services such as an electrical outlet, light and fan in which the fan air outlet can be adjusted such that outlet air can be directed in any position between the horizontal and vertical. The fan is a conventional squirrel cage blower which is mounted for movement on the frame of the device by a slidable washer assembly movable within a track placed in the frame. The incorporation of a handle allows the combination device to be carried and used in working areas that lack air circulation and easy access to light and electricity.

3 Claims, 5 Drawing Figures

COMBINED POWER DEVICE, LIGHT AND FAN

BACKGROUND OF THE INVENTION

1. Field of the Invention

This invention relates to a portable handyman's device, and in particular to a device containing a combination of independently operated electrical services including electrical outlets for acting as an electrical extension, a light source and a fan to provide air circulation.

2. Disclosure Statement

U.S. Pat. No. 2,582,572, issued Jan. 15, 1952, to Tulk, and U.S. Pat. No. 2,909,316, issued Oct. 20, 1959, to Prohacka et al, disclose portable electric fans each of which contains an electric light attachment. The portable combination fan and light devices disclosed by these patents comprise conventional rotating prop fans which cannot be adjusted relative to the frame of the device to control the direction of air flow. These combination devices also lack electrical power outlets and thereby cannot act as a source of power for electrically driven tools in remote locations, such as attics, boat bilges, etc., which may require do-it-yourself or tradesmen handiwork.

U.S. Pat. No. 2,912,195, issued Nov. 10, 1959, to Austin, discloses a support structure for a blower housing comprising means to adjust and change the direction of the output of the blower. The support structure disclosed in this patent is not for a combination device, nor does it appear that the blower housing can be adjusted in all positions ranging from horizontal to vertical as does the device of the present invention. U.S. Pat. No. 2,133,985, issued Oct. 25, 1938, to Green, relates to electric fans and particularly to those in which the motor and fan oscillate back and forth laterally. This patent utilizes a flexible cord which electrically connects the swaying fan with the electric motor.

SUMMARY OF THE INVENTION

In accordance with the present invention, a combination electrical device is provided as a convenient tool for the home do-it-yourselfer or tradesmen when working in areas that lack air circulation and easy access to light and electrical power. The combination device of the present invention includes an electrical power source in the form of an outlet to enable the device to act as an electrical extension cord, includes a lamp to provide illumination while traversing or working in areas where lighting may be required, and includes a two-speed blower which can be moved relative to the housing of the combination device for directing air in any position between horizontal and vertical. In small enclosed areas, air directed vertically toward the ceiling provides a large envelope of circulated air while the horizontal position can be used to direct air directly on the work area or operator. The electrical outlet is provided in a pair of outlets which enable the user of the device to connect electric tools, such as power saws, drills, etc., to a source of electricity. The combination device includes an extension cord which is permanently affixed to the frame of the device and wired to the outlet switches and lamp and further provides electricity to operate the blower. The three electrical services provided on the combination device can be used independently of each other.

Accordingly, it is an object of the present invention to provide the home handyman or tradesman with a combination device capable of providing a plurality of electrical services, such as a source of power, light and air circulation.

It is a further object of the invention to provide a combination electrical device positioned in a single frame member, which is portable and which provides a source of power, a source of illumination and a blower for providing air circulation.

A further object of the invention is to provide a combination electrical device containing a source of electrical power and a blower which is movable relative to the frame of the device to direct air in any position between horizontal and vertical, the device optionally containing a source of illumination.

A still further object of the invention is to provide a combination electrical device which contains a source of electrical power, a source of illumination and a blower which can provide a flow of air directed in any position between horizontal and vertical and in which any one of the three electrical services can be used independently of the others.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
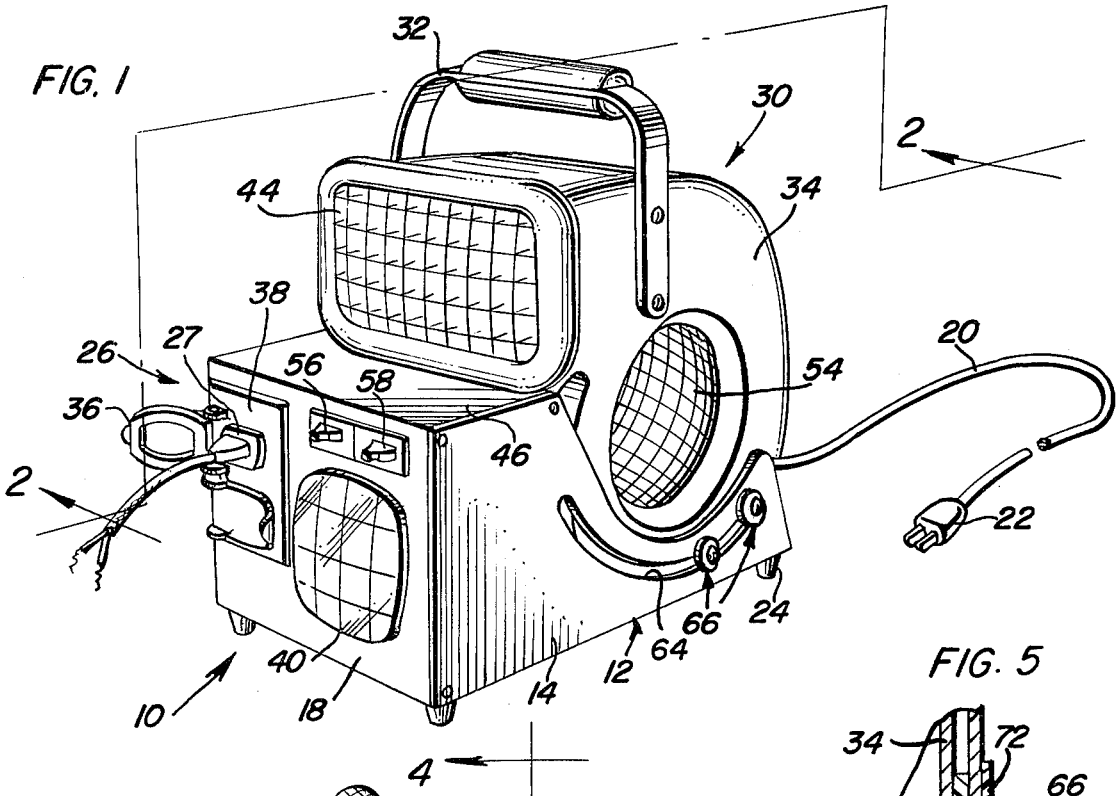
FIG. 1 is a perspective view of the combination electrical device of the present invention.

Referring to FIGS. 1 through 4, the combination electrical device of the present invention is generally indicated by reference numeral 10. Device 10 comprises a frame 12 including a pair of side frame members 14 and 16 and a front panel 18. Combination device 10 is connected to a source of electrical power through built-in extension cord 20 containing electrical connector plug 22 at the end thereof. Placed on the bottom of frame 12 are four rubber pads 24 for supporting device 10 on a flat surface.

Combination electrical device 10 is designed to provide a plurality of electrical services which can operate independently from each other. The electrical services provided in combination device 10 comprise a duplex weather guard outlet 26, lamp 28 and blower 30. A handle 32 fastened to blower housing 34 enables combination device 10 to be carried easily by hand producing a convenient portable device. Duplex electrical outlet 26 is formed by a pair of electrical sockets 27, one of which is shown in use, and a pair of weather guards 36 covering sockets 27 when not in use, preventing the entry of dust, moisture, etc. Outlet guards 36 are pivotally mounted to outlet box 38 for conveniently providing access to outlets 27. Lamp 28, preferably 30 to 40 watts, is provided with a fresnel lens 40 protruding through and affixed to the outside surface of front panel 18.

Frame 12 is shaped to accommodate blower housing 34 permanently but movably mounted to side frame members 14 and 16. The rounded cutout portion of frame 12 accommodates blower housing 34 for all positions of blower outlet 42, such as the horizontal position shown in FIGS. 1 and 2 to the vertical position in which outlet 42 is positioned vertically upward, the body portion of lower housing 34 being accommodated between side members 14 and 16. Outlet 42 having placed thereon a grille 44 is positioned slightly above top surface 46 of frame 12 when outlet 42 is in the full horizontal position. Blower 30 is a conventional two-speed squirrel cage blower comprising rotors 48 rotated by shaft 50 of motor 52. A wire mesh guard 54 placed in blower housing 34 is an added safety feature.

Switches 56 and 58 operate blower 30 and lamp 28, respectively. The switches are part of a conventional electrical circuit including electrical control box 60 which receives power through s second control box 61 and extension cord 20. Power for operating blower 30 is achieved through an electrical connection (not shown) from control box 61 to motor 52. Frame member 12 is electrically grounded for safety. Bracket 62 placed at the rear of blower housing 34 holds cord 20 in a wrapped condition during storage. Duplex electrical outlet 26 is also electrically connected to control box 61 to provide power for tools connected to electrical outlets 27. The three electrical services, duplex outlet 26, lamp 28 and blower 30 can be independently operated from each other and thus used singly or in combination depending upon the needs or preferences of the operator.

Figure 5:
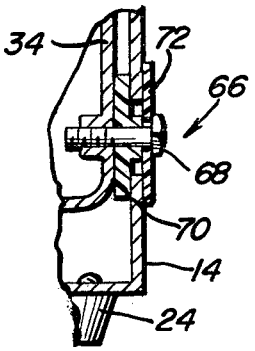
FIG. 5 is an enlarged sectional view illustrating the attachment assembly of the blower, which enables the blower to swivel and direct air in any desired position between horizontal and vertical.
Figure 2:
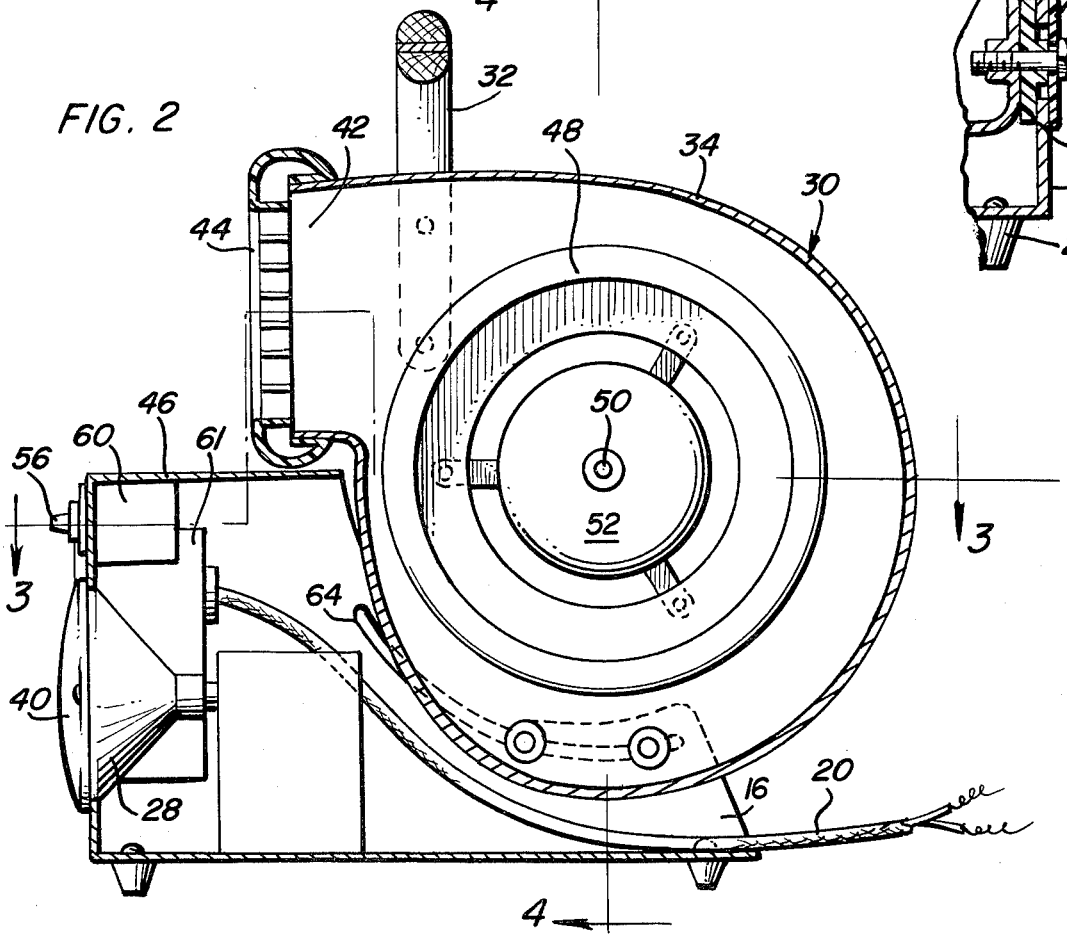
FIG. 2 is a longitudinal sectional view of the combination device taken generally along the line 2—2 of FIG. 1.
Figure 3:
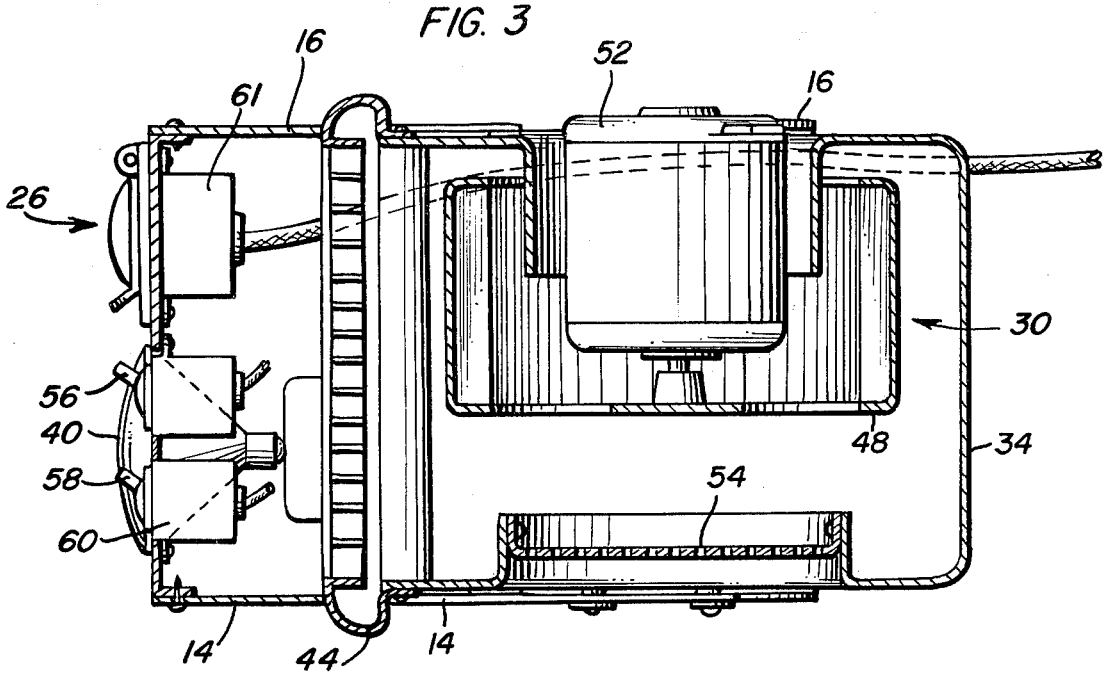
FIG. 3 is a transverse sectional view of the combination electrical device taken generally along the line 3—3 of FIG. 2.
Figure 4:
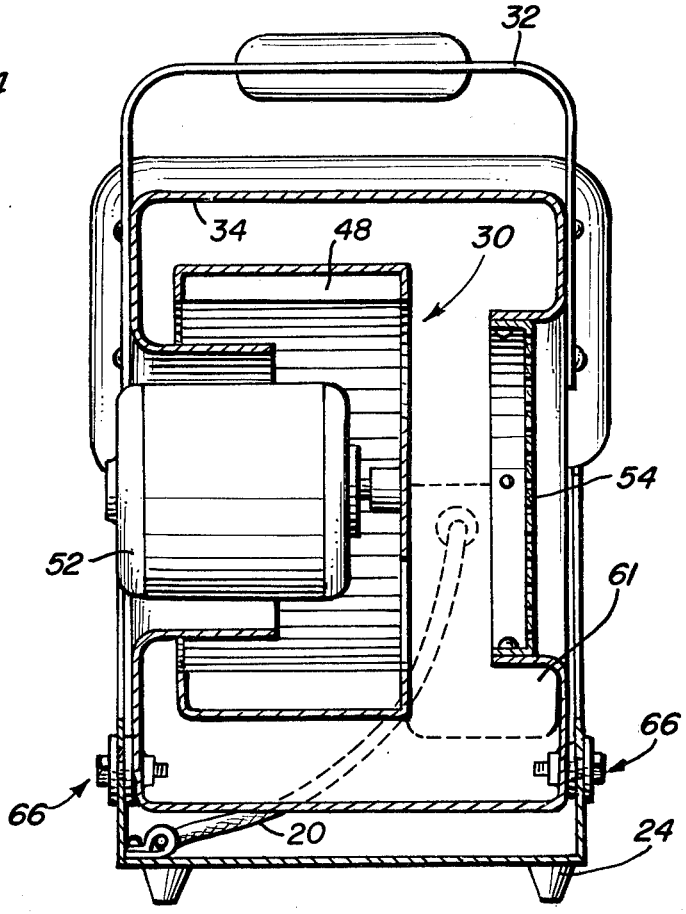
FIG. 4 is a transverse sectional view of the combination device of the present invention taken generally along the line 4—4 of FIG. 2.

An important feature of the present invention involves the movement of outlet 42 of blower 30 90° from the horizontal position to a vertical position and all directions therebetween. Illustrated in FIGS. 1, 2 and 5 is the mechanism by which the movement of blower 30 to change the direction of air flow is provided. A pair of arcuate slots 64 conforming substantially to the circular shape of blower housing 34 are placed in correspondingly exact positions in respective side members 14 and 16 in frame 12. Placed within each slot 64 are a pair of friction assemblies 66 comprising a screw 68 extending from outside frame 12 and threaded into blower housing 34. Respective side members 14 and 16 are sandwiched between a nylon bushing 70 and nylon washer 72, nylon washer 72 being urged against the respective side member, nylon bushing 70 positioned between the respective side member and blower housing 34. The position of the friction assemblies in arcuate slot 64 determines the position and direction of flow of air from outlet 42. As can be determined from FIG. 1, by positioning friction assemblies 66 within slot 64 at the end toward the rear of frame 12, outlet 42 is in a horizontal position directing air along an area at the front of frame 12. By loosening screw 68 and moving friction assembly 66 along arcuate slot 64 toward the end at the frontmost part of frame 12, outlet 42 swings upwardly by reason of the threaded connection between screw 68 and blower housing 34. As can be seen, the flow of air from outlet 42 can be adjusted to flow in any direction within the 90° angle from horizontal, as shown in FIG. 1, to a upwardly vertical direction.

The materials of construction of combination electrical device 10 are preferably lightweight materials, such as aluminum or plastic, or a combination of these materials of construction to form the component parts of the device. Many uses of the device are contemplated and all such conventional uses can be readily determined from the description of device 10.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A combined portable light, electrical outlet and fan assembly comprising a supporting frame including a generally vertical front panel and side frame members, means stably supporting the frame on a support surface, electrical outlet socket means mounted on said front panel, a light mounted on said front panel for directing a light beam forwardly of the assembly, a blower housing mounted on said side frame members, a blower mounted in said housing, said blower housing being generally cylindrical in configuration and having a tangential air outlet, a handle attached to said blower housing to enable the assembly to be carried to a desired site of use, an electrical cord and plug adapted to engage with an electrical outlet for supplying electrical energy to the outlet socket means, light and blower, a switch for selectively actuating the blower independent of the light, a switch for actuating the light independently of the blower, said electrical outlet socket means being directly electrically connected with the cord for energization independent of the blower and light, said blower housing having end walls with each end wall including an air inlet, and means connecting the blower housing to the side frame members for pivotal movement of the housing about a horizontal axis generally parallel to the front panel without interference with air entering the air inlets for movement of the air outlet between a horizontal position in which air is directed forwardly of the front panel toward a work area illuminated by the light and a vertical position to enable air to be discharged in a desired direction, said handle being offset from the pivot axis of the blower housing to enable application of rotational torque to the blower housing.

2. The portable assembly of claim 1 wherein said connecting means between the blower housing and side frame members includes a friction assembly interconnecting each end wall and a side frame member to enable pivotal movement only when force is applied to the handle and frictionally retain the blower housing in any adjusted position.

3. The portable assembly as defined in claim 2 wherein said connecting means between the blower housing and side frame members includes an arcuate slot in each side frame member, each end wall of the housing having a pair of fasteners mounted thereon and extending through the adjacent slot, each of said fasteners having a friction assembly mounted thereon, each friction assembly including spaced friction members mounted on each fastener in frictional engagement with opposite surfaces of the end wall along the slot, said side frame members having an arcuate cutout in the upper edge portion to eliminate interference with air entering the inlets, said arcuate slots being disposed close to the edge of the cutouts in the side frame members.

* * * * *